United States Patent [19]

Clark

[11] Patent Number: 4,997,315

[45] Date of Patent: Mar. 5, 1991

[54] CRIB WALLS

[75] Inventor: Erin C. Clark, Wellington, New Zealand

[73] Assignee: Erin Clark Holdings Limited, Kilbirnie, New Zealand

[21] Appl. No.: 439,979

[22] Filed: Nov. 22, 1989

[30] Foreign Application Priority Data

Nov. 22, 1988 [NZ] New Zealand ..... 227044
Dec. 20, 1988 [NZ] New Zealand ..... 227409

[51] Int. Cl.[5] ..... E02D 17/00
[52] U.S. Cl. ..... 405/273; 405/284
[58] Field of Search ..... 405/272, 273, 284, 285, 405/286; 52/169.2, 169.4, 233

[56] References Cited

U.S. PATENT DOCUMENTS

| | | | |
|---|---|---|---|
| 1,331,186 | 2/1920 | DeGaray | 405/272 X |
| 1,703,303 | 2/1929 | Fitzgerald | 405/273 |
| 4,068,482 | 1/1978 | Hilfiker | 405/272 |
| 4,490,075 | 12/1984 | Risi et al. | 405/273 X |
| 4,664,562 | 5/1987 | Clark et al. | 405/273 |
| 4,840,003 | 6/1989 | Lucas et al. | 405/284 X |

*Primary Examiner*—Randolph A. Reese
*Assistant Examiner*—John A. Ricci
*Attorney, Agent, or Firm*—Fleit, Jacobson, Cohn, Price, Holman & Stern

[57] ABSTRACT

A method for making a corner and a corner formed thereby for a crib wall having a setback includes preparing a base for the two walls to provide the required setback of each wall, laying on the base the wall headers and a corner header of the tier, laying on the wall headers and the corner header the required structures and keys and/or header support blocks to complete the first tier, thereafter laying on stretchers and keys and/or header support blocks of the first tier the wall headers and corner header of the second tier above the substantially corresponding components of the first tier, and continuing tiering of the wall, the arrangement being that each corner header includes a stretcher-receiving groove at the top and bottom thereof with respect to the tiering direction in which the ends of stretchers from the two walls can butt, or almost butt, the lower groove of each corner header being closer to the outside of the corner and the upper groove.

19 Claims, 6 Drawing Sheets

CRIB WALLS

The present invention relates to crib walls and improvements in crib walls, and in particular to a method of crib walling to provide an improved corner. The invention also consists in a novel corner header for use in the provision of such corners.

Preferably the inner spacing of tiered corner headers is achieved by use of header support blocks rather than the use of keys, the preferred header support blocks being those disclosed in New Zealand Patent Specification No. 205792 and corresponding U.S. Pat. No. 4,664,562.

These prior art publications disclose a method of forming a crib wall having a "set back", i.e. while the wall is of a tiered structure and while there may be additional reinforcements at lower levels (e.g. header support blocks) the structure still resembles a wall (whether staged or otherwise) which moves inwardly at a substantially progressive rate as the wall rises. The full content of the New Zealand patent specification is herein included by way of reference including the reference in FIG. 4 of the drawing thereof showing that in a preferred form of such a crib wall (using headers as depicted and as represented in New Zealand Design Registration No. 18633) there is provided for each rise of four units of the wall a "set back" horizontally of one unit.

The crib wall, as depicted in the above referred to prior art, is formed on a base (concrete, sleepers or the like) at the required disposition to set off the required "set back" when the components are subsequently tiered thereon. Thereafter the wall structure is formed from headers as previously described which pass through the full width of the wall and which are adapted by means of transverse grooves both top and bottom at the outer end thereof (i.e. that end not to be back filled) to locate wall wise extending stretchers. Similar top and bottom groovings at the inward end are adapted to receive and locate either stretchers or keys. In the preferred form the headers are provided with longitudinally (with respect to the header itself) extending top and bottom grooves to locate the tongue of header support blocks to be interposed between the tiers of headers as depicted in the prior art referred to above.

With such a "set back" form of crib wall there has traditionally been a difficulty in forming a neat and stable corner, and it is to this that the present invention is directed.

The degree of "set back" is not critical and while hereafter a set back of 1 in 5.656 is described any other set back almost to the vertical and to the other extreme can be used and may be dictated by design constraints. Common "set backs" may be 1 in 4 or 1 in 3. A 1 in 4 set back corresponds to about 40 mm back stepping of stretchers between layers in the preferred framework dimensions.

BRIEF SUMMARY OF THE INVENTION

Accordingly in one aspect the present invention consists in a method of forming a corner of a crib wall having a "set back", each set back wall of the crib wall being defined by wall headers which locate stretchers therebetween, the wall headers extending transversely of the wall while the stretchers run longitudinally of the wall adjacent the outside thereof, there being keys and/or header support blocks supporting the spacing between tiers of said wall headers inwardly (with respect to the wall) of said stretchers, said method comprising preparing a "base" (which may or may not include sleepers) for the two walls to provide the required "set back" of each wall, laying on the base the wall headers and a corner header of the first tier, laying on the wall headers and the corner header the required stretchers and keys and/or header support blocks to complete the first tier, thereafter laying on said stretchers and keys and/or header support blocks of the first tier the wall headers and corner header of the second tier above the substantially corresponding components of the first tier and continuing the tiering of the wall, the arrangement being characterized in that each corner header includes a stretcher receiving transverse groove on the top and bottom thereof with respect to the tiering direction in which the ends of stretchers from the two walls can butt or almost butt, the lower groove of each corner header being closer to the outside of the corner than the upper groove.

Preferably a wall header of at least one of the two walls being laid up on the base or as part of a subsequent tier, is of a shorter length than at least most of the remainder of the wall headers in that at least one wall remote from said corner, and from any similar other corner formed thereby, and that shorter wall header is adjacent to a corner header.

Preferably a wall header of each wall of shorter length is laid up on the base or as part of a subsequent tier adjacent to the corner header.

Preferably any such shorter wall headers are spaced inwardly between tiers by a header support block.

Preferably corner headers are spaced between tiers by a header support block.

Preferably said corner is an internal corner.

Preferably said corner is an external corner.

Preferably said ends of stretchers from the two walls butt or almost butt without provision of any bevelling in either component.

Preferably at least the majority of the components of the crib walls and the corner is of timber.

Preferably the stretchers which butt or almost butt at a corner may be pinned or nailed one to another within a particular tier.

Preferably the corner header is laid at a setback different to that of normal length wall headers of each wall corresponding to the relationship that for a setback of about four to one setback of each wall the corner header is setback so that it drops one unit for every inward movement of about 5.656 units.

Preferably the top and bottom grooves of a corner header are greater in width than of the top and bottom stretcher or key locating grooves of each wall header.

Preferably said walls are formed substantially in a manner as disclosed in New Zealand Patent Specification No. 205792 preferably using headers as disclosed in New Zealand Design Registration No. 18633. It is to be noted, however, that New Zealand Patent Specification No. 205792 refers back to a earlier form of crib wall i.e. as disclosed in our New Zealand Patent Specification No. 195408 (corresponding to Australian Patent Application No. 76710/81) and U.S. Pat. No. 4,664,562, and in its broadest scope the present invention should be interpreted as extending to the provision of corners to crib walls of that type, or indeed any other type to which a corner as disclosed can be provided.

In a further aspect the present invention consists in a crib wall, whether internal or external, which has been formed by a method as previously defined.

In still a further aspect the present invention consists in a setback corner of any angle from 0° to 360° defined by an intersection of two setback crib walls, each wall of the crib wall being defined by wall headers which locate stretchers therebetween, the wall headers extending transversely of the wall while the stretchers run longitudinally of the wall adjacent to the outside thereof, there being keys and/or header support blocks supporting the spacing between tiers of said wall headers inwardly (with respect to the wall) of said stretchers, said wall being characterized in that at the corner in a particular tier one wall header most adjacent the corner of at least one of the walls forming the corner is shorter in length than the majority of the wall headers (the "normal wall headers") in that wall and there is provided a corner header shorter in length than such normal wall headers and receiving in a top and bottom groove thereof the butting or almost butting ends of stretchers of each wall, the top and bottom grooves of such a corner header being greater in width than that of the normal wall headers in order to accommodate the butting or almost butting condition from the angled walls.

In yet a further aspect the present invention consists in a corner wherein said corner headers are spaced between tiers by a longitudinally tongued header support block engaged top and bottom in a longitudinal groove of the corner headers.

Preferably said corner could have been made by a method as previously defined.

In a further aspect of the present invention consists in a corner header substantially as hereinafter described with reference to the accompanying drawings and preferably including top and bottom longitudinally extending grooves therein so that the inward ends thereof at the top and bottom can locate a header support block.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

BRIEF DESCRIPTION OF THE DRAWINGS

One preferred form of the present invention will now be described with reference to the accompanying drawings wherein:

FIGS. 4A and 4B are diagrams which show the "set back" arrangement, FIG. 4A showing the 4 to 1 set in of the walls while FIG. 4B shows the mating 5.656 to 1 set in of the corner headers.

DETAILED DESCRIPTION

In the preferred form of the present invention the crib walls are formed tier wise on a concrete base having the required set in for each wall and the corresponding set in for the corner headers as previously described. Preferably certain form work members can be employed which will ensure the appropriate set in of the preferred concrete base. In other forms a non-concrete base can be utilized including ballast and sleepers so that the same preferred requirement for the set in is achieved.

Figure 1:
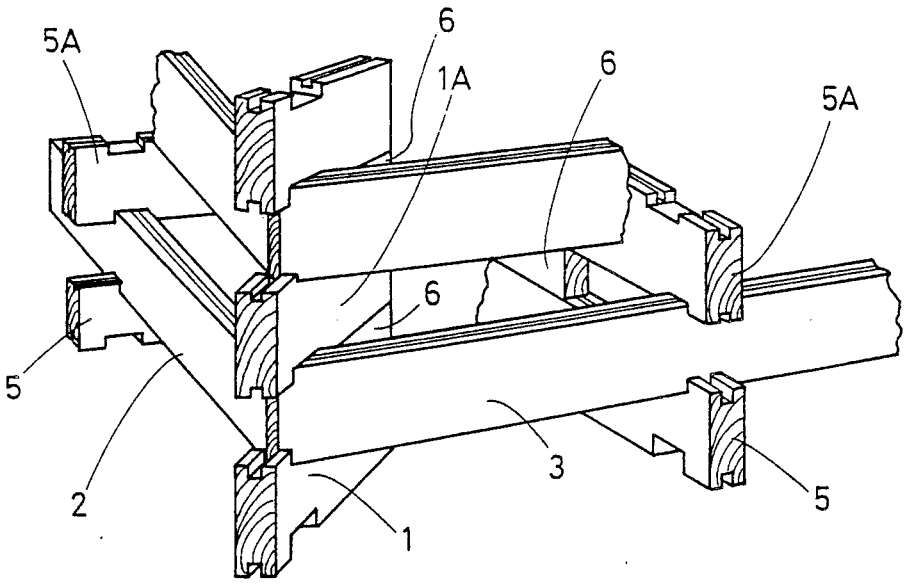
FIG. 1 is a perspective view of a preferred crib wall in accordance with the present invention there being shown at the outer end of a corner a tiering of corner headers and along therefrom a tiering of the normal wall headers which locate in transverse grooves the stretchers which lie therein to extend and butt at right angles (without bevelling) within the extended transverse groove of a corner header where they can be (only if necessary—not preferred) nailed or pinned so that both butting ends are supported at least in part by the base of the top groove of a corner header.
Figure 2:
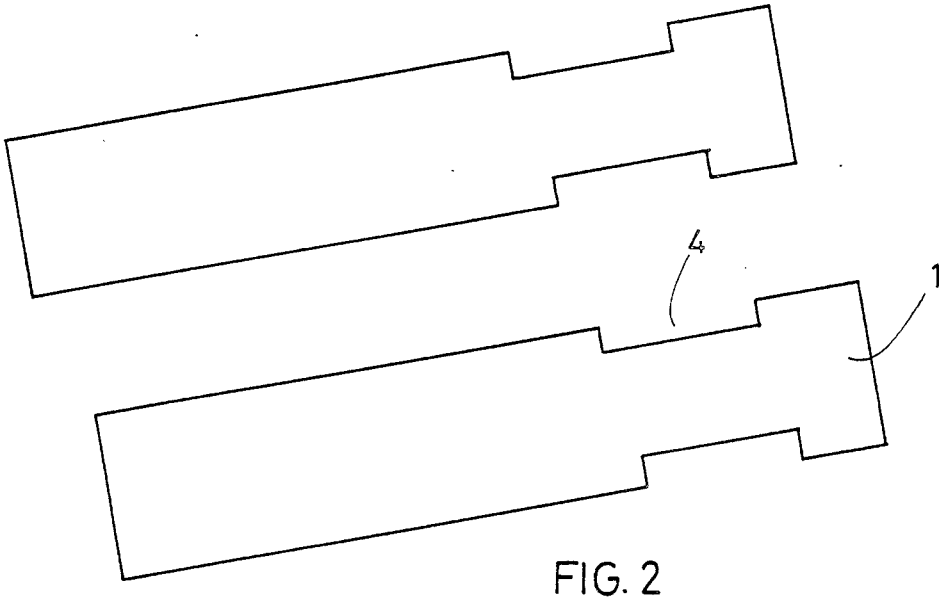
FIG. 2 is an elevational view of the preferred form of corner header showing a pair of such corner headers in a tiered relationship, the offset top and bottom grooves showing how progressively the required setting in of the corner to match the mating set in of the two walls can occur.
Figure 5:
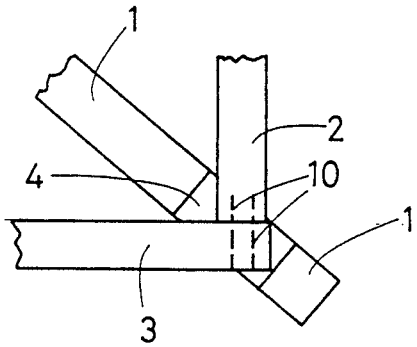
FIG. 5 shows how stretcher butting at right angles position with a transverse groove of a corner header.
Figure 6:
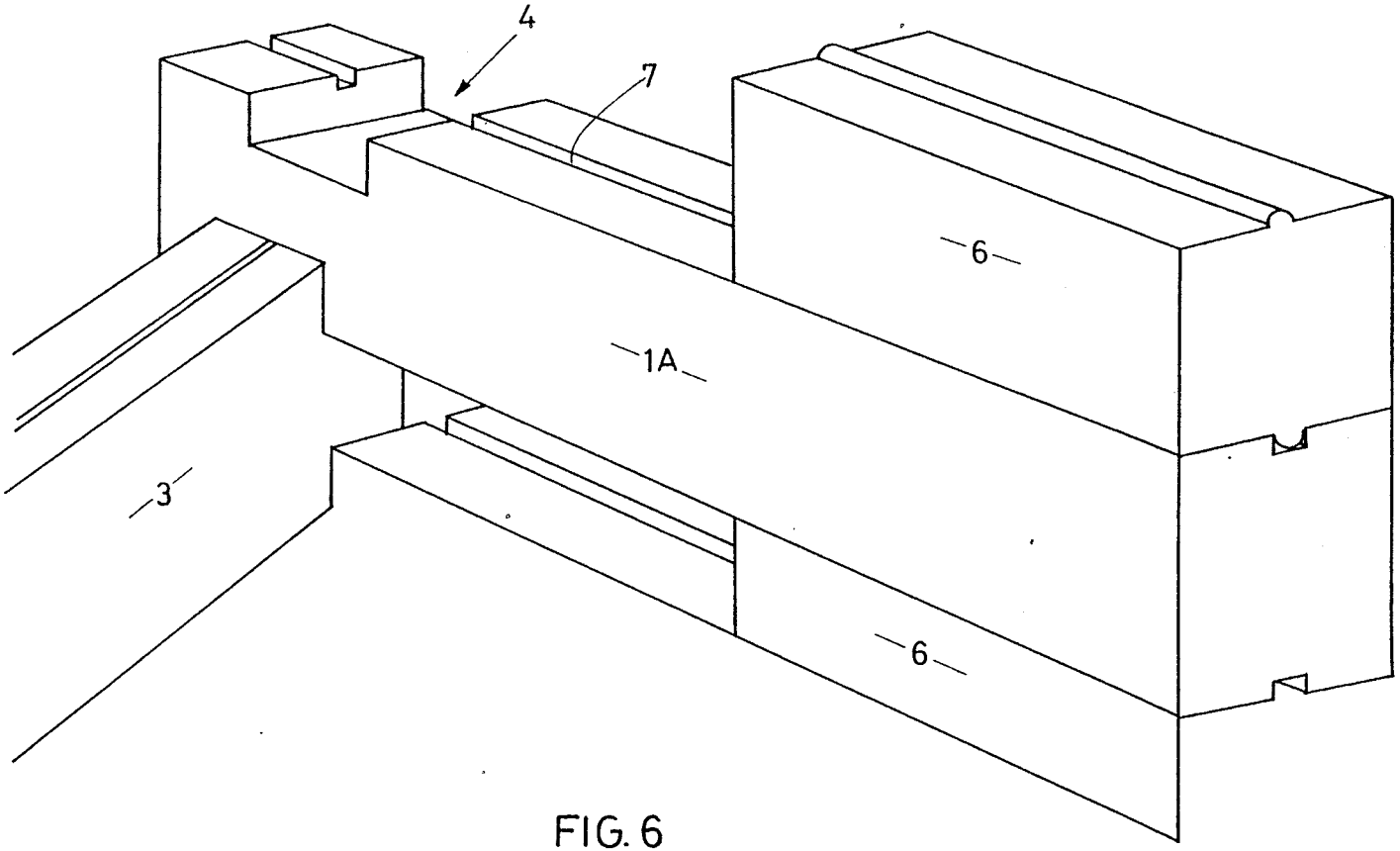
FIG. 6 shows the arrangement of FIG. 5 viewed from within.

The first step is to locate the wall headers and the corner headers on the base. Thereafter the stretchers keys (if any) and header support blocks 6 are then positioned thereon i.e. on both corner headers 1, 1A and wall headers 5, 5A. As shown in FIG. 1, a corner header 1 has stretchers 2 and 3 from the two different walls mated at the appropriate butting angle (e.g. right angles or any other angle) in the top groove 4 (see FIG. 2 and FIG. 5) and they are only if necessary pinned (not preferrably) one to the other (eg. by nailing at 10—see FIG. 5) so that each is located to derive vertical support from the base of the broader groove 4 of the corner header. Thereafter above the wall headers 5 the next tiering of wall headers 5A occurs and so forth while the subsequent tiering of corner headers 1A occurs. Of course, header support blocks 6 are employed as are any necessary keys or rear stretchers. These are not critical to an understanding of the invention.

Figure 3:
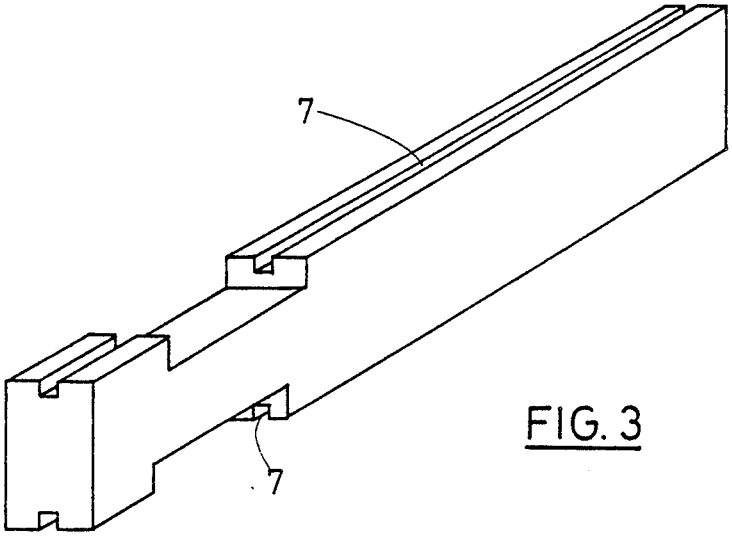
FIG. 3 is a perspective view of a preferred corner header showing how as with the other header components there is a top and bottom longitudinal grooving for header support block location (preferably the longitudinal groovings not breaking the base of the transverse stretcher locating groovings)
Figure 4A:
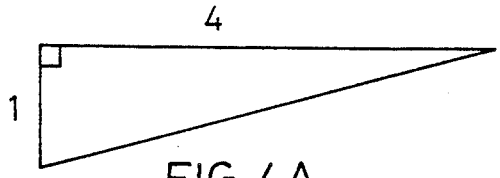
Figure 4B:
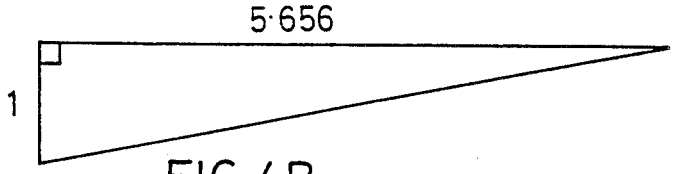

As can be seen by FIG. 3 the preferred corner header is provided with a longitudinally extending top and bottom groove 7 to locate thereon in the tongue and groove arrangement (as disclosed in New Zealand Patent Specification No. 205792) a header support block 6 between proximate tiered corner headers.

Preferably the preferred corner headers are approximately 305 mm long with a cross section prior to grooving of 92 mm (vertical) by 36 mm or 46 mm. While 305 mm long corner headers can be used a longer length of say 440 mm (less easily packed) can also be used. The transverse top and bottom grooves are preferably 92 mm across (extend that far along the corner header) with the top-most transverse groove being set in from the outer end by 59 mm while the preferred corresponding sized groove at the bottom thereof is set in by only 45 mm. Thus, for the particular "set back" of the walls and the requirement for a setting back at the corner of 1 to 5.656 there is a differential of 14 mm between the set in of the top and bottom transverse grooves to locate the ends of stretchers.

Other models of corner header can be 550 and 733 mm long. For example, machined from 100×40 mm timber a 550 mm corner header has a main cross section of 92×36 mm. A 733 mm corner header machined from 100×50 mm timber has a main cross section of 92×46 mm.

Preferably the longitudinal groovings of the corner headers are less in depth than the 14 mm depth of the transverse grooves.

The present invention relates to crib walls being formed with an internal or external corner of any angle from 0° to 360°. Obviously it will not be a corner if it is 180° or is 0° or 360°.

To accommodate tight corners of the external type as shown in all of the accompanying drawings (internal corners also fall into the scope of the present invention), it is desirable that one or both of those wall headers in a tier adjacent to the corner header is shorter than the majority of the remainder of the wall headers.

Figure 7:
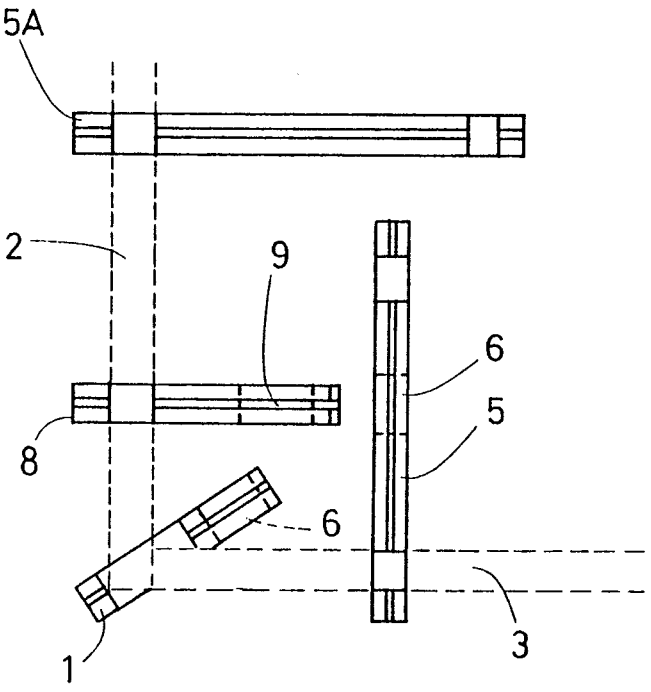
FIG. 7 is a plain diagrammatic view of the wall headers and corner header of the base or any subsequent tier showing normal length wall headers in each wall but with the wall having a wall header of shorter length adjacent the corner header.

In FIG. 7 there are shown stretchers 2 and 3 of a particular tier shown in broken outline, and a corner header 1 to be spaced by a header support block 6 shown in broken outline. One wall includes normal length wall headers 5A which can, if desired, include header support blocks (not shown) while the other wall includes normal length headers 5 which can, for example, include a header support block 6 shown in broken outline. To avoid interference between wall header 5 and wall header 8 adjacent to the corner header 1, wall header 8 has a shorter length than wall header 5A of the same wall. The shorter wall header 8 is preferably spaced between tiers by header support blocks 9 shown in broken outline so that the same angle of setback is obtained for wall header 8 from an appropriate base as is obtained for wall header 5A.

Figure 8:
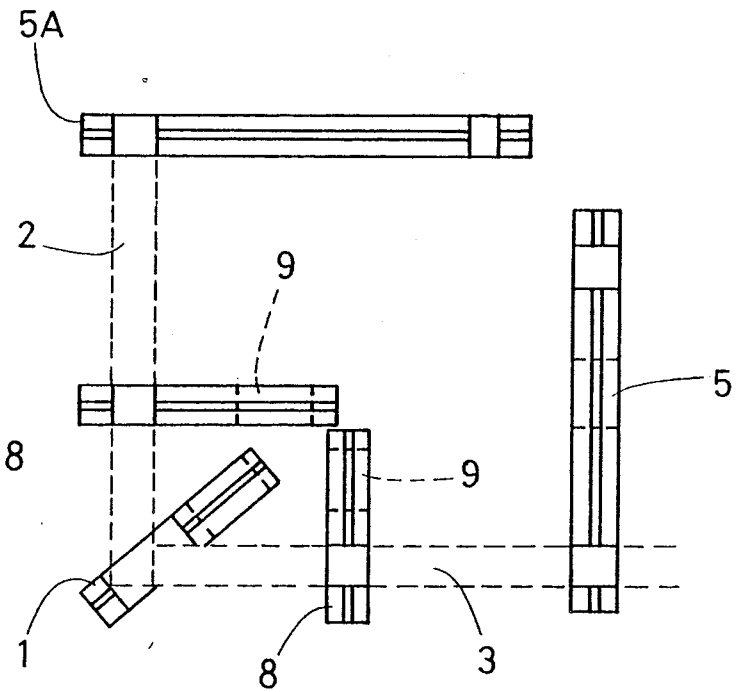
FIG. 8 is a similar view to that of FIG. 7 but showing how, if desired, a shorter wall header can be placed adjacent to the corner header in each of the two walls.

FIG. 8 is a slight variation of the arrangement shown in FIG. 7 where a second shortened wall header is used. This too is denoted by reference 8 and header support block 9 and is positioned in place of normal wall header 5 of the previous FIG. 7 or in addition thereto. With such a pairing of two shortened wall headers 8 it is possible to have such wall headers closer to a corner header than is otherwise the case and this will ensure a more accurate location of the butting or almost butting stretchers 2 and 3 into the groove of the pair of corner headers to locate the same both top and bottom.

Figure 9:
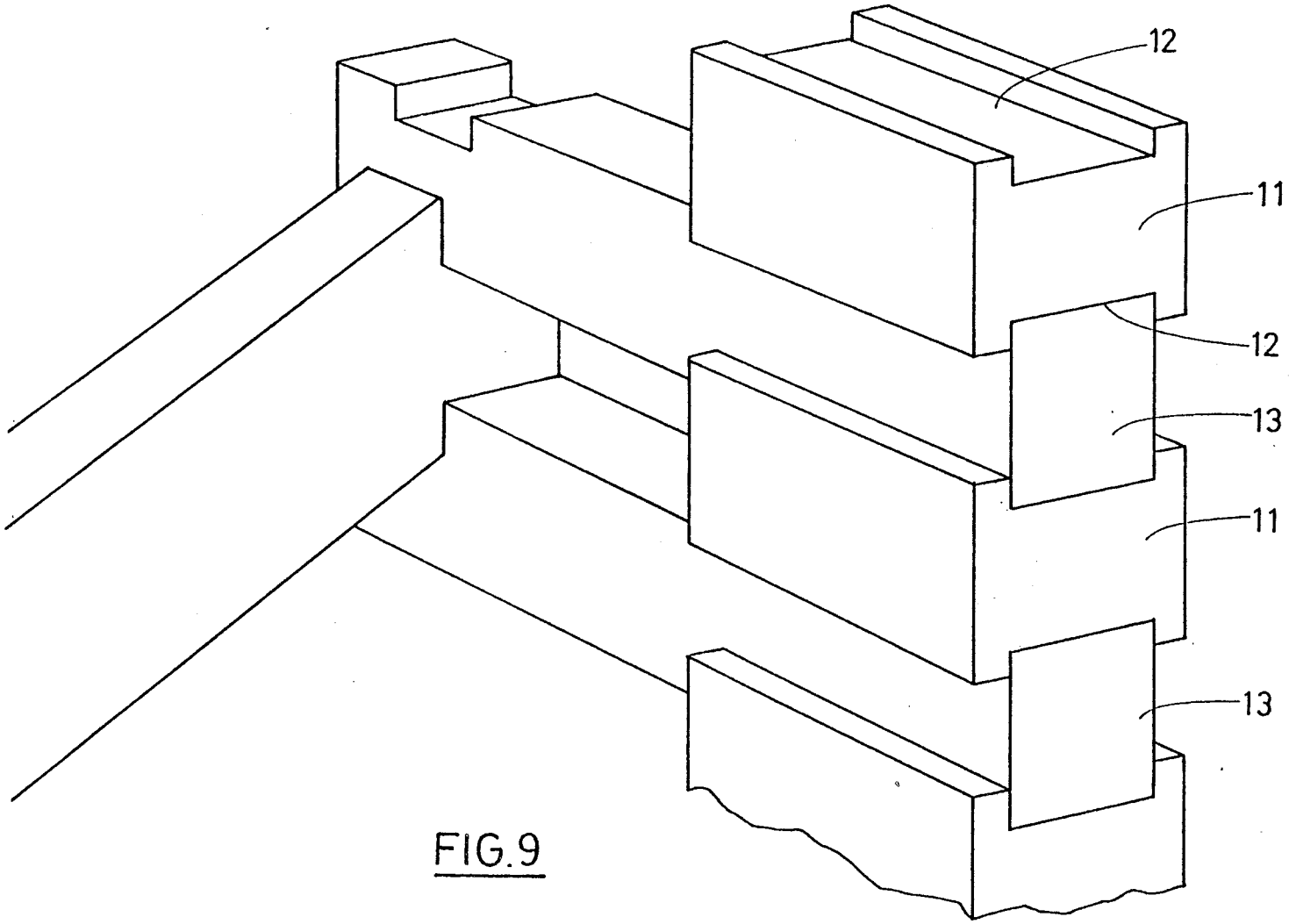
FIG. 9 is a similar view to FIG. 6 but showing alternative arrangements for the tongue and groove engagement of FIG. 6 between headers and header support blocks where the groove was a longitudinal groove on the header and the tongue a longitudinal tongue on the header support blocks, i.e. the reverse where part of the header itself fits into the recess of the header support block.

While in the preferred form of the present invention the headers are provided with longitudinal grooves and the header support blocks with longitudinal tongues (skeletal or otherwise and irrespective of whether or not the longitudinal wall header or a corner header of the present invention), a person skilled in the art will appreciate other means whereby a firm locating can occur between headers or corner headers and interposed header support blocks. FIG. 9 shows such an arrangement whereby the header support blocks 11 include a longitudinal locating groove 12 top and bottom to locate the wall headers or corner headers 13 therebetween. Such a form of the present invention is not the most preferred owing to packing difficulties.

Figure 11:
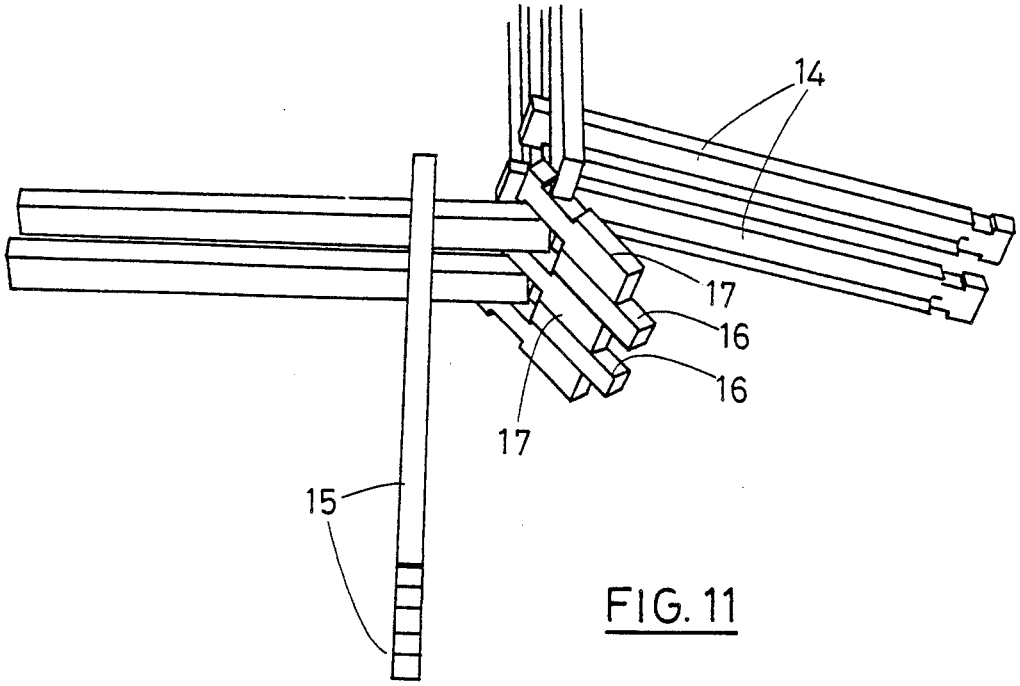
FIG. 11 shows a variation of the arrangement shown in FIG. 10 whereby an "internal" corner is defined, i.e. the headers and the corner headers together with their header support blocks are back filled so that the "set back" of the internal corner is back into the back fill, FIGS. 10 and 11 for convenience do not show the mode whereby the corner headers inter-engage with header support blocks and additionally for simplicity omit header support blocks between the normal wall headers.
Figure 10:
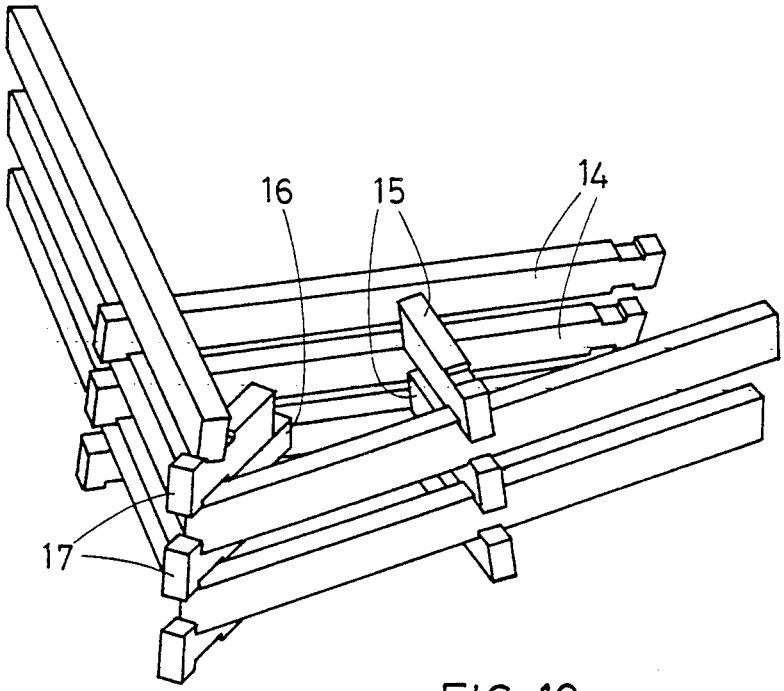
FIG. 10 is a perspective view of a corner such as shown in FIG. 1 or FIGS. 7 and 8 which defines an "external" corner, the header of each wall being shown as being of different lengths and of course the corner headers preferably being shorter in length.

FIGS. 10 and 11 show respectively an "external" corner and a "internal" corner. In each case the headers including the corner headers are on that side of the structure to be back filled and the "set in" is from bottom to top back towards the back fill. For convenience FIGS. 10 and 11 do not show header support blocks interposed between wall headers 14 or 15 and additionally for convenience header support blocks 16 are shown located between corner headers 17 without any particular locating tongue and groove inter-relationship.

A person skilled in the art will appreciate how for the first time both an aesthetic and stable crib wall corner can be simply formed by the employment of the components of the present invention.

What is claimed is:

1. A method of forming a corner of a crib wall formed of two walls having a set back, each set back wall of the crib wall being defined by wall headers which locate stretchers therebetween, the wall headers extending transversely of the wall while the stretchers run longitudinally of the wall adjacent the outside thereof, and at least one of keys and header support blocks in the spacing between tiers of the wall headers inwardly, with respect to the wall, for supporting said stretchers, the method comprising:

preparing a base for the two walls to provide the required set back of each wall;

providing corner headers having near one end thereof to be positioned at the outside of the corner transverse stretcher receiving grooves in the top and bottom thereof relating to the tiering direction, the bottom groove being closer to said one end than the top groove;

laying on the base wall headers and a corner header of a first tier;

laying on said wall headers and corner header of said first tier the required stretchers and at least one of the keys and header support blocks to complete the first tier, said stretcher being positioned with the ends thereof in said top grooves of said corner header and in substantially abutting relationship;

laying on said stretchers and said at least one of keys and header support blocks of said first tier wall headers and a corner header of a second tier substantially above corresponding components of said first tier; and continuing the above sequence of steps to complete the tiering of the wall;

said wall headers of at least one of said tier walls positioned adjacent to said corner header for each tier being shorter in length than wall headers, of the at least one wall, positioned remote from said corner headers.

2. A method as claimed in claim 1 comprising:

for each wall, laying the base wall header of said shorter length adjacent to the corner header on the base.

3. A method as claimed in claim 2 comprising:

placing a header support block between said shorter length wall header of adjacent tiers inwardly of the respective wall.

4. A method as claimed in claim 1 comprising:

for each wall, laying on as part of a tier above said first tier a wall header of said shorter length adjacent to the corner header of the same tier.

5. A method as claimed in claim 4 comprising:

placing a header support block between said shorter length wall header of adjacent tiers inwardly of the respective wall.

6. A method as claimed in claim 1 comprising:

placing header support blocks between said corner headers of adjacent tiers.

7. A method as claimed in claim 1 wherein said corner is an internal corner.

8. A method as claimed in claim 1 wherein said corner is an external corner.

9. A method as claimed in claim 1 and further comprising:

providing transverse grooves in the top and bottom of said wall headers for locating said stretchers therein;

said top and bottom grooves of said corner header being greater in width than said top and bottom grooves in said wall header.

10. A set back corner for a crib wall of any angle from 0° to 360° defined by an intersection of two set back crib walls each formed by stretchers extending longitudinally and adjacent the outside of the wall, normal headers extending transversely relative to the respective two walls and having top and bottom grooves for receiving and locating the stretcher, and at least one of keys and header support blocks between the normal wall headers of adjacent tiers of the crib wall for spacing and supporting the normal wall headers inwardly of the crib wall relative to the stretcher, the improvement comprising:

a shorter wall header for at least one tier adjacent the corner for at least one of the walls forming the corner having a shorter length than the majority of the normal wall headers of said at least one wall;

a corner header for each tier having a shorter length than said normal wall headers; and top and bottom grooves in said corner headers having a width greater than the width of the top and bottom grooves in the normal wall headers for receiving the ends of stretchers of the two walls in substantially abutting relationship.

11. The improvement as claimed in claim 10 wherein:

said top and bottom grooves in said corner header are adjacent one end of said corner header positioned at the corner of the crib wall; and the bottom groove of said corner header is closer to said one end than said top groove thereof.

12. The improvement as claimed in claim 11 and further comprising:

longitudinal grooves in the top and bottom of each corner header;

header support blocks between said corner headers of adjacent tiers for supporting said corner headers in spaced relationship; and longitudinal tongues in the top and bottom of each header support block engaging in said longitudinal grooves of respective corner headers.

13. The improvement as claimed in claim 10 and further comprising:

longitudinal grooves in the top and bottom of each corner header;

header support blocks between said corner headers of adjacent tiers for supporting said corner headers in spaced relationship; and longitudinal tongues in the top and bottom of each header support block engaging in said longitudinal grooves of respective corner headers.

14. A method of forming a corner of a crib wall formed of two walls having a set back, each set back wall of the crib wall being defined by wall headers which locate stretchers therebetween, the wall headers extending transversely of the wall while the stretchers run longitudinally of the wall adjacent the outside thereof, and at least one of keys and header support blocks in the spacing between tiers of the wall headers inwardly, with respect to the wall, for supporting said stretchers, the method comprising:

preparing a base for the two walls to provide the required set back of each wall;

providing corner headers having near one end thereof to be positioned at the outside of the corner transverse stretcher receiving grooves in the top and bottom thereof relating to the tiering direction, the bottom groove being closer to said one end than the top groove;

laying on the base wall headers and a corner header of a first tier;

laying on said wall headers and corner header of said first tier the required stretchers and at least one of the keys and header support blocks to complete the first tier, said stretcher being positioned with the ends thereof in said top grooves of said corner header and in substantially abutting relationship;

laying on said stretchers and said at least one of keys and header support blocks of said first tier wall headers and a corner header of a second tier substantially above corresponding components of said first tier; and continuing the above sequence of steps to complete the tiering of the wall.

15. A method as claimed in claim 14 wherein said corner is an internal corner.

16. A method as claimed claim 14 wherein said corner is an external corner.

17. A method as claimed in claim 14 wherein the corner header is laid at a setback different to that of wall headers of each wall corresponding to the relationship that for a setback of about four to one setback of each wall the corner header is setback so that it drops one unit for every inward movement of about 5.656 units.

18. A method as claimed in claim 14 comprising:

placing header support blocks between said corner headers of adjacent tiers.

19. A method as claimed in claim 14 and further comprising:

providing transverse grooves in the top and bottom of said wall headers for locating said stretchers therein;

said top and bottom grooves of said corner header being greater in width than said top and bottom grooves in said wall header.

* * * * *